US006792631B1

(12) United States Patent
Hayden

(10) Patent No.: US 6,792,631 B1
(45) Date of Patent: Sep. 21, 2004

(54) FABRIC COVER ASSEMBLY FOR A FOLDABLE SLEEPING MAT

(76) Inventor: Patricia D. Hayden, 2038 Mauvilla Cove, Biloxi, MS (US) 39531

( * ) Notice: Subject to any disclaimer, the term of this patent is extended or adjusted under 35 U.S.C. 154(b) by 0 days.

(21) Appl. No.: 10/617,589

(22) Filed: Jul. 11, 2003

(51) Int. Cl.[7] ..... A47G 9/08
(52) U.S. Cl. ..... 5/417; 5/413 R
(58) Field of Search ..... 5/482, 485, 458, 5/496, 413 R, 413 AM

(56) References Cited

U.S. PATENT DOCUMENTS 3,774,249 A * 11/1973 Ybarra et al. ..... 5/419
4,601,076 A * 7/1986 Knobeloch ..... 5/413 R
5,787,527 A 8/1998 Anderson
6,065,164 A 5/2000 Swanger et al.
6,651,277 B1 * 11/2003 Marson ..... 5/420

OTHER PUBLICATIONS

"Happi–Nappi™ Pull–Off Mat Cover with Attached Sheet"; www.happinappi.com; pp. 1–2; Published prior to Jul. 11, 2003.

* cited by examiner

*Primary Examiner*—Teri Pham Luu
*Assistant Examiner*—Fredrick Conley
(74) *Attorney, Agent, or Firm*—Schwartz Law Firm P.C.

(57) ABSTRACT

A cover assembly for a foldable sleeping mat includes a mat case with top and bottom fabric panels having joined side edges and joined end edges. The bottom panel defines a lateral opening receiving the sleeping mat inside the mat case. A blanket is attached to one end of the mat case, and has a free end adapted for covering a user lying on the sleeping mat. A pocket is provided for releasably holding the free end of the blanket to the mat case with the blanket in a substantially spread out condition over the sleeping mat. The blanket, mat case, and sleeping mat are folded together in overlying sections when storing the sleeping mat for later use.

15 Claims, 7 Drawing Sheets

FABRIC COVER ASSEMBLY FOR A FOLDABLE SLEEPING MAT

TECHNICAL FIELD AND BACKGROUND OF THE INVENTION

This invention relates to a fabric cover assembly for a foldable sleeping mat, such as that used by a toddler during nap time. Conventional sleeping mats are generally formed in padded rectangular sections joined at respective longitudinally-spaced fold lines. The invention covers the entire sleeping mat, and is especially applicable for use at child day cares to provide a soft and sanitary barrier between the toddler and mat surface. The invention further includes an attached blanket for covering the toddler, and having a free end adapted for being releasably held to the covered mat prior to folding to facilitate handling and storage, and allowing immediate usage of the covered mat and blanket upon unfolding.

Sleeping or "nap" mat covers are well known in the prior art. According to one such cover described in U.S. Pat. No. 6,065,164, an opening is formed at one end of the cover to receive the nap mat and is temporarily closed using an end fastener, such as mating hook and loop fasteners, buttons, or snaps. Because the end fastener is easily accessed by the child when using the mat, the fastener may be released by the child causing the cover to inadvertently slide away from and uncover the mat. This creates a disheveled condition and exposes what is generally an unclean mat surface.

Unlike the present invention, the prior art cover does not have an attached blanket. The present blanket is attached at the foot of the sleeping mat, and will generally remain spread over the toddler when napping. Blankets used separate from the cover are often strewn to the side of the mat, and are not conveniently foldable together with the mat.

SUMMARY OF INVENTION

Therefore, it is an object of the invention to provide a fabric cover assembly designed for covering a foldable sleeping mat.

It is another object of the invention to provide fabric cover assembly which includes an attached blanket.

It is another object of the invention to provide fabric cover assembly which is conveniently foldable together with the sleeping mat for easy handling and storage.

It is another object of the invention to provide fabric cover assembly which will not readily pull away from the mat.

It is another object of the invention to provide fabric cover assembly which is removable from the mat and launderable.

It is another object of the invention to provide fabric cover assembly which is folded together with the sleeping mat, and which remains assembled over the mat when unfolded.

It is another object of the invention to provide a method of folding a sleeping mat, mat cover, and blanket together for easy handling and storage.

These and other objects of the present invention are achieved in the preferred embodiments disclosed below by providing a cover assembly for a foldable sleeping mat. The cover assembly includes a mat case with top and bottom fabric panels having joined side edges and joined end edges. The bottom panel defines a lateral opening for receiving the sleeping mat inside the mat case. A blanket is attached to one end of the mat case, and has a free end adapted for covering a user lying on the sleeping mat. Means are provided for releasably holding the free end of the blanket to the mat case with the blanket in a substantially spread out condition over the sleeping mat. The blanket, mat case, and sleeping mat are folded together in overlying sections when storing the sleeping mat for later use.

The term "blanket" refers broadly herein to any fabric covering.

The term "joined" means either two formerly separate fabric panels attached together by sewing, or integrally formed by, for example, folding over a panel to define an edge.

The term "folded" refers to an element or elements which are arranged in overlying sections by either doubling over or rolling up.

According to another preferred embodiment of the invention, the blanket holding means includes at least one pocket located at the free end of the blanket. The pocket is designed for receiving a top portion of the sleeping mat therein to secure the blanket to the mat.

According to another preferred embodiment of the invention, the blanket holding means includes first and second pockets located at opposite corners of the free end of the blanket. The pockets are designed for receiving respective opposing mat corners at a head end of the sleeping mat to secure the blanket to the mat.

According to another preferred embodiment of the invention, the lateral opening is defined by overlapping bottom panel sections cooperating to maintain coverage of the mat case over the sleeping mat at the opening.

According to another preferred embodiment of the invention, the blanket has sufficient width and length to cover the top fabric panel of the mat case when spread.

According to another preferred embodiment of the invention, the blanket is sewn along a bottom of the mat case from one side of the mat case to the other.

According to another preferred embodiment of the invention, the length of the blanket is substantially equal to the length of the mat case.

In another embodiment, the invention is a method of folding a sleeping mat, mat cover, and blanket together for storage. The method includes the steps of spreading a free end of the blanket over the mat cover from a foot end of the sleeping mat to a head end of the sleeping mat. The opposing mat corners at the head end of the sleeping mat are tucked into respective pockets located at a free end of the blanket. The sleeping mat, mat cover, and blanket are then folded together in overlying sections with the mat cover and blanket secured to both the foot and head ends of the sleeping mat.

BRIEF DESCRIPTION OF THE DRAWINGS

Some of the objects of the invention have been set forth above. Other objects and advantages of the invention will appear as the description proceeds when taken in conjunction with the following drawings, in which.

DESCRIPTION OF THE PREFERRED EMBODIMENT AND BEST MODE

Figure 1:
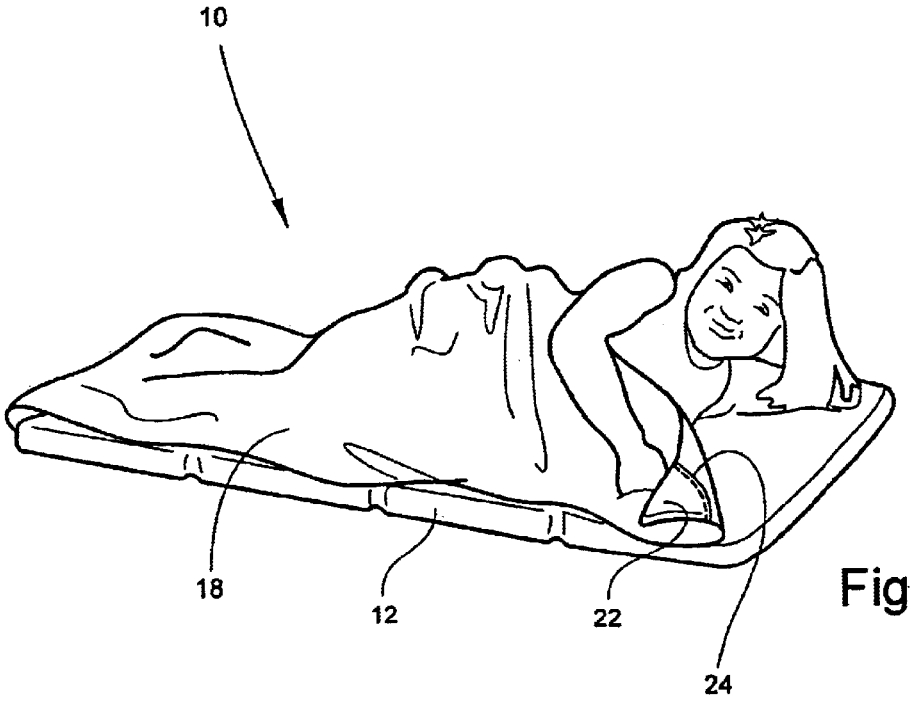
FIG. 1 is an environmental perspective view of the fabric cover assembly according to one preferred embodiment of the present invention, and showing the cover assembly in-use applied to a conventional foldable sleeping mat for young children.
Figure 2:
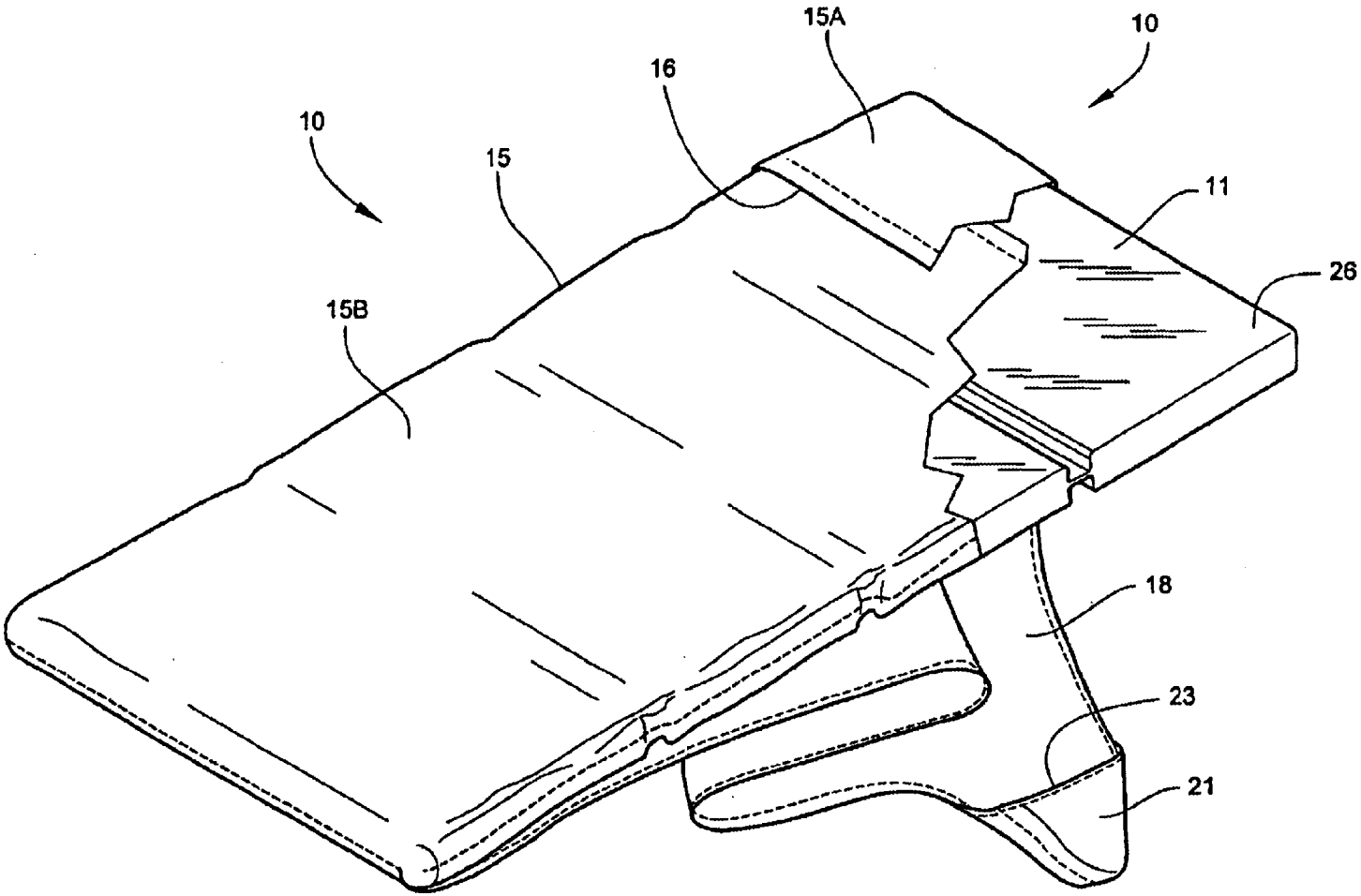
FIG. 2 is a perspective view of a bottom side of the cover assembly with a portion of the mat case cut away to show the sleeping mat.
Figure 3:
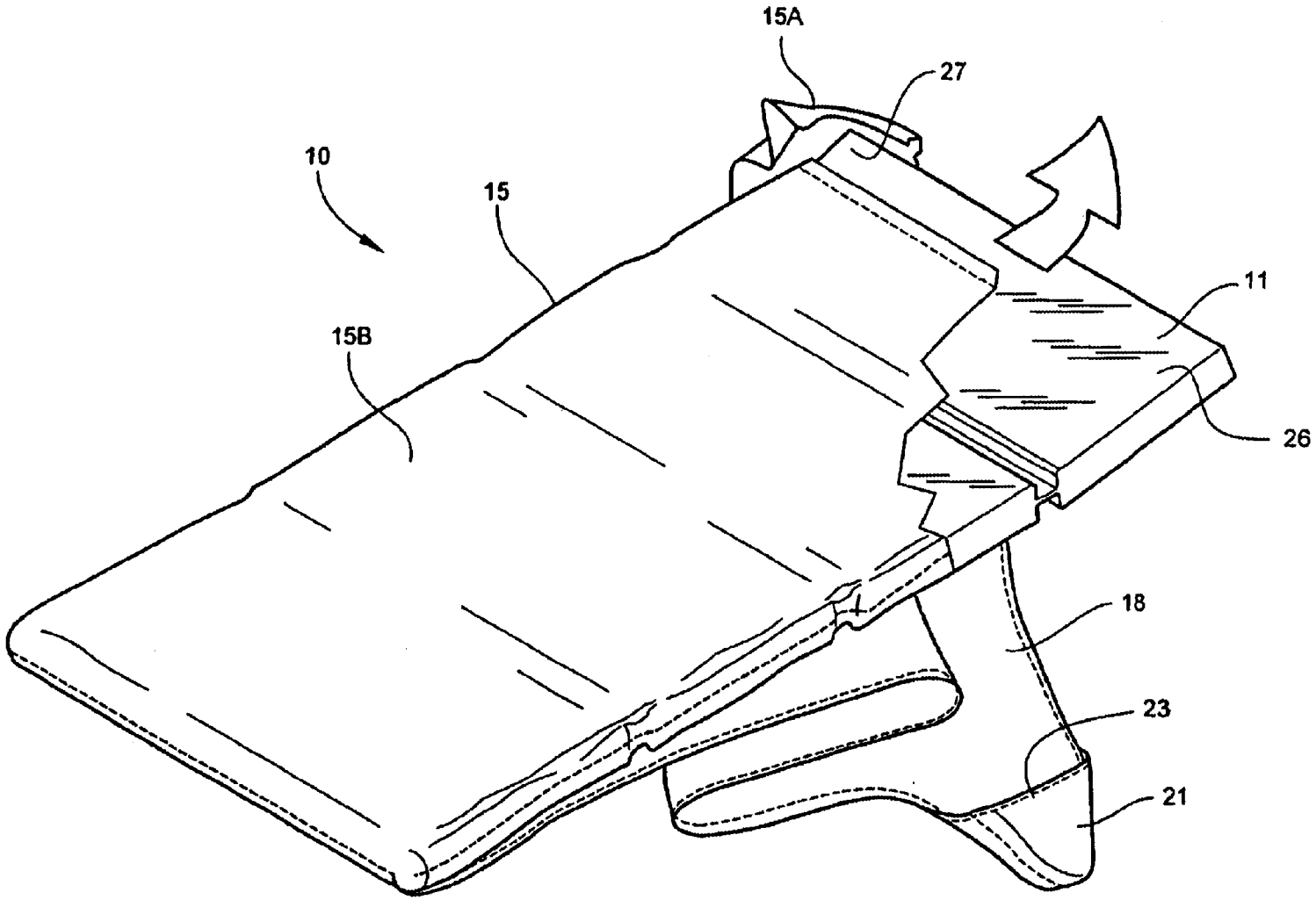
FIG. 3 is a further perspective view of the bottom side of the cover assembly with a portion of the mat case cut away and demonstrating how the sleeping mat is removed from the case.

Referring now specifically to the drawings, a fabric cover assembly according to the present invention is illustrated in FIG. 1, and shown generally at reference numeral 10. The cover assembly 10 is applicable for covering a padded foldable sleeping mat 11, shown in FIGS. 2 and 3, such as that used by toddlers during nap time. The sleeping mat 11 is arranged within a knit fabric case 12 formed by overlying top and bottom panels 14, 15 joined together along opposing side edges and opposing end edges. The bottom panel 15 includes overlapping panel sections 15A, 15B which define a lateral opening 16 adapted to receive and remove the sleeping mat 11 from inside the fabric case 12. The overlapping panel sections 15A, 15B cooperate to maintain full coverage of the fabric case 12 over the sleeping mat 11, and to prevent inadvertent removal or pulling back of the fabric case 12 from the sleeping mat 11 during use. The panel sections 15A, 15B may include releasable fasteners, such as mating hook and loop patches. The sleeping mat 11 is removed from the fabric case 12, as demonstrated in FIG. 3, by pulling the panel section 15A outwardly to expose an end of the sleeping mat 11, and then pulling the sleeping mat 11 outwardly from inside the case 12.

Figure 4:
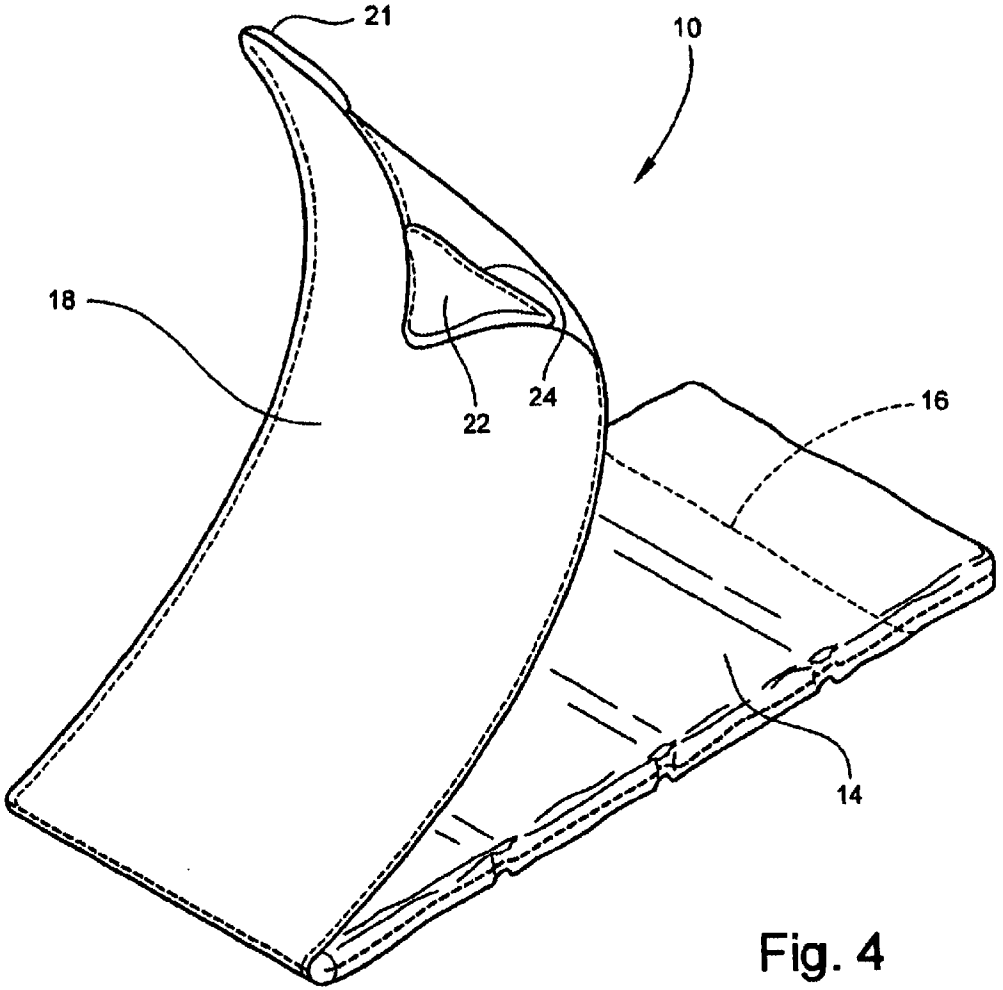
FIG. 4 is a perspective view showing a top side of the cover assembly applied to the sleeping mat with the attached blanket lifted away from the mat case.
Figure 5:
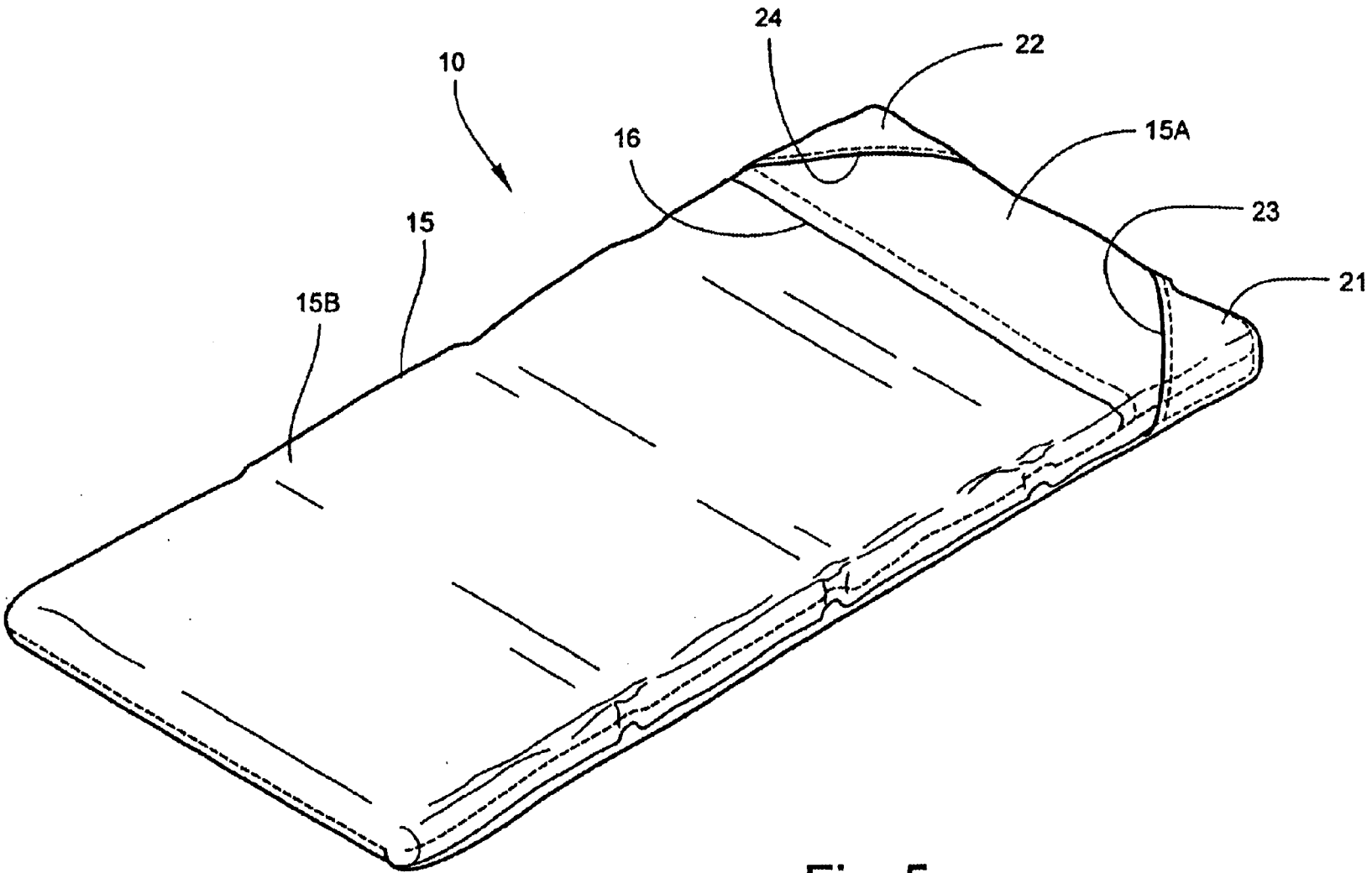
FIG. 5 is a perspective view showing the bottom side of the cover assembly applied to the sleeping mat with the pockets of the blanket arranged over the mat corners.
Figure 6:
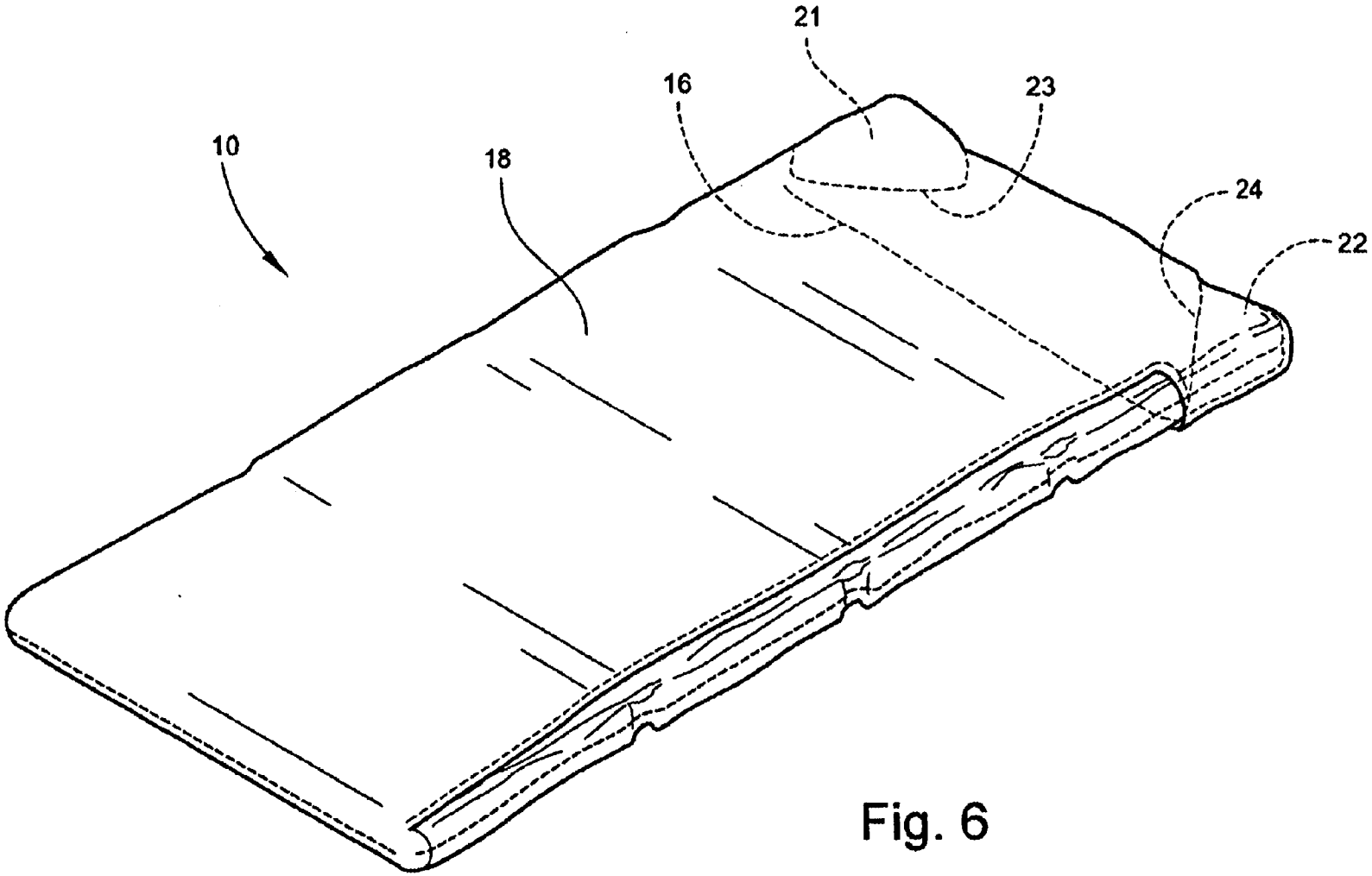
FIG. 6 is a perspective view showing the top side of the cover assembly applied to the sleeping mat with the pockets arranged over the mat corners.

A soft woven blanket 18 is sewn along one end edge of the fabric case 12, and extends from a foot end of the sleeping mat 11 to the head end. Preferably, the width of the blanket 18 is substantially equal to the width of the sleeping mat 11. As best shown in FIGS. 4, 5, and 6, a pair of inside pockets 21, 22 are located at opposite corners of the free end of the blanket 18. The pockets 21, 22 have openings 23, 24 designed for receiving respective opposing mat corners 26, 27 (See FIG. 3) at the head end of the sleeping mat 11. Prior to folding the sleeping mat 11 and cover assembly 10, as described below, the blanket 18 is spread out over the covered mat 11 and pulled gently to remove any wrinkles. Preferably, the length of the blanket 18 is substantially equal to the length of the sleeping mat 11. The pockets 21, 22 receive the mat corners 26, 27 to hold the blanket 18 firmly in position on the sleeping mat 11. Alternative means (not shown) for holding the blanket 18 to the covered mat 11 include mating hook and loop fasteners, snap fasteners, buttons, zipper and the like.

Figure 7:
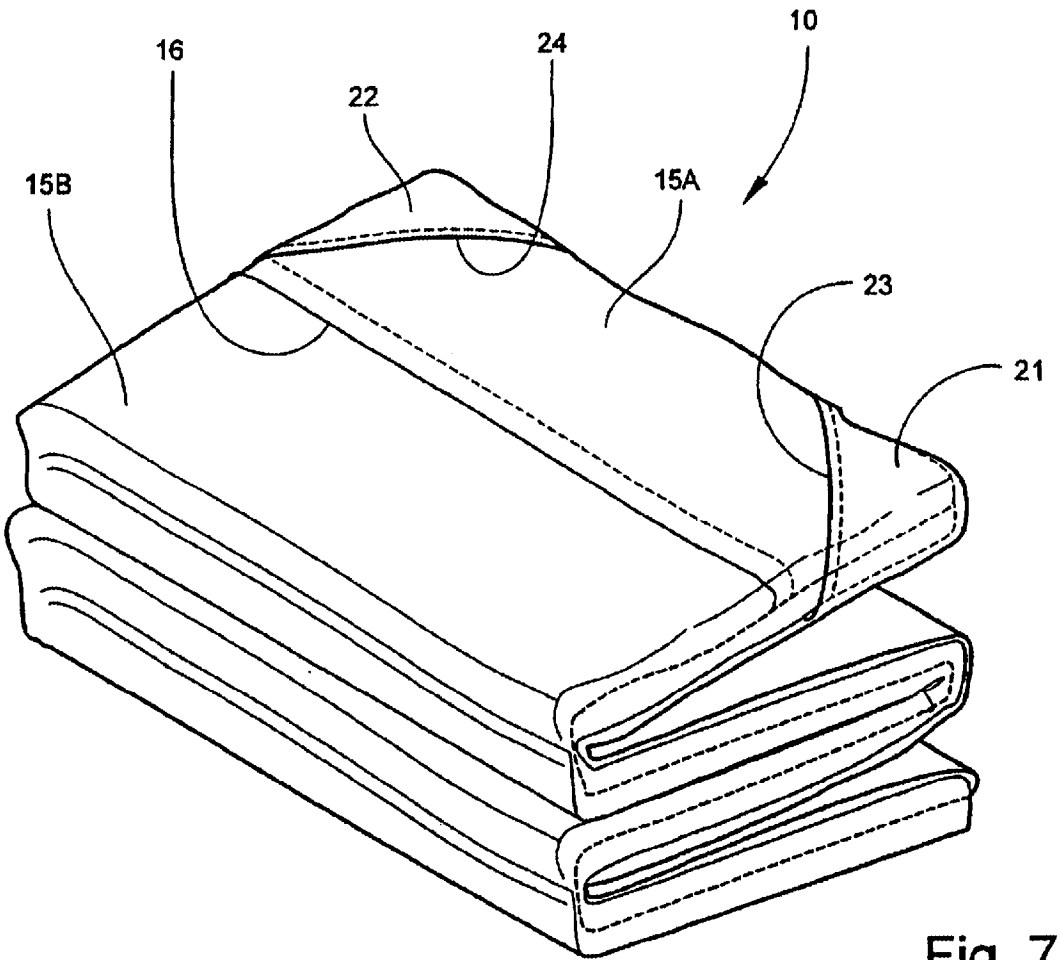
FIG. 7 is a perspective view of the cover assembly and sleeping mat when folded for handling and storage.

With the pockets 21, 22 arranged over the mat corners 26, 27, the sleeping mat 11 and cover assembly 10 are folded together in overlying sections, as shown in FIG. 7, to facilitate handling and storage when the sleeping mat 11 is not in use. The resulting folded package is neat and orderly, easy to handle, and is readily unfolded in a covered assembled condition for immediate use.

A fabric cover assembly for a sleeping mat is described above. Various details of the invention may be changed without departing from its scope. Furthermore, the foregoing description of the preferred embodiment of the invention and best mode for practicing the invention are provided for the purpose of illustration only and not for the purpose of limitation—the invention being defined by the claims.

I claim:

1. A cover assembly for a foldable sleeping mat, comprising:

(a) a mat case including top and bottom fabric panels having joined side edges and joined end edges, and said bottom panel defining a lateral opening for receiving the sleeping mat inside said mat case;

(b) a blanket attached to one end of said mat case, and having a free end adapted for covering a user lying on the sleeping mat; and (c) means for releasably holding the free end of said blanket to said mat case with said blanket in a substantially spread out condition over the sleeping mat, wherein said blanket holding means comprises at least one pocket located at the free end of said blanket, and designed for receiving a top portion of the sleeping mat therein to secure said blanket to the mat, whereby said blanket, mat case, and sleeping mat are folded together in overlying sections when storing the sleeping mat for later use.

2. A cover assembly according to claim 1, wherein said blanket holding means comprises first and second pockets located at opposite corners of the free end of said blanket, and designed for receiving respective opposing mat corners at a head end of the sleeping mat to secure said blanket to the mat.

3. A cover assembly according to claim 1, wherein said lateral opening is defined by overlapping bottom panel sections cooperating to maintain coverage of said mat case over the sleeping mat at said opening.

4. A cover assembly according to claim 1, wherein said blanket has sufficient width and length to cover the top fabric panel of said mat case when spread.

5. A cover assembly according to claim 1, wherein said blanket is sewn along a bottom of said mat case from one side of said mat case to the other.

6. A cover assembly according to claim 1, wherein the length of said blanket is substantially equal to the length of said mat case.

7. A cover assembly for a foldable sleeping mat, comprising:

(a) a mat case including top and bottom fabric panels having joined side edges and joined end edges, and said bottom panel defining a lateral opening for receiving the sleeping mat inside said mat case, whereby said mat case entirely covers the sleeping mat from a foot end thereof to a head end thereof;

(b) a blanket attached to one end of said mat case, and having a free end adapted for extending from the foot end of the sleeping mat to the head end of the sleeping mat; and (c) first and second pockets located at opposite corners of the free end of said blanket, and adapted for receiving respective opposing mat corners at the head end of the sleeping mat to releasably hold the free end of said blanket to the sleeping mat, whereby said blanket, mat case, and sleeping mat are folded together in overlying sections when storing the sleeping mat for later use.

8. A cover assembly according to claim 7, wherein said lateral opening is defined by overlapping bottom panel sections cooperating to maintain coverage of said mat case over the sleeping mat at said opening.

9. In combination with a foldable sleeping mat, a fabric cover assembly comprising:

(a) a mat case including top and bottom fabric panels having joined side edges and joined end edges, and said bottom panel defining a lateral opening receiving said sleeping mat inside said mat case;

(b) a blanket attached to one end of said mat case, and having a free end adapted for covering a user lying on said sleeping mat; and (c) means for releasably holding the free end of said blanket to said mat case with said blanket in a substantially spread out condition over said sleeping mat, wherein said blanket holding means comprises at least one pocket located at the free end of said blanket, and receiving a top portion of said sleeping mat therein to secure said blanket to said mat, whereby said blanket, mat case, and sleeping mat are folded together in overlying sections when storing said sleeping mat for later use.

10. A combination according to claim 9, wherein said blanket holding means comprises first and second pockets located at opposite corners of the free end of said blanket, and adapted for receiving respective opposing mat corners at a head end of the sleeping mat to secure said blanket to said mat.

11. A combination according to claim 9, wherein said lateral opening comprises overlapping bottom panel sections cooperating to maintain coverage of said mat case over said sleeping mat at said opening.

12. A combination according to claim 9, wherein said blanket has sufficient width and length to cover the top fabric panel of said case when spread.

13. A combination according to claim 9, wherein said blanket is sewn along a bottom of said mat case from one side of said mat case to the other.

14. A combination according to claim 9, wherein the length of said blanket is substantially equal to the length of said mat case.

15. A method of folding a sleeping mat, mat cover, and blanket together for storage, said method comprising the steps of:

(a) spreading a free end of the blanket over the mat cover from a foot end of the sleeping mat to a head end of the sleeping mat;

(b) tucking opposing mat corners at the head end of the sleeping mat into respective pockets located at a free end of the blanket; and (c) folding the sleeping mat, mat cover, and blanket together in overlying sections with the mat cover and blanket secured to both the foot and head ends of the sleeping mat.

* * * * *